US006796556B2

(12) United States Patent
Robertson et al.

(10) Patent No.: US 6,796,556 B2
(45) Date of Patent: Sep. 28, 2004

(54) MULTI-FUNCTION MEDIA EJECT SYSTEM IN AN INK JET PRINTER

(75) Inventors: Douglas Laurence Robertson, Lexington, KY (US); Randall David Mayo, Georgetown, KY (US); Barry Baxter Stout, Lexington, KY (US); Michael Anthony Marra, III, Lexington, KY (US); Walter Kevin Cousins, Lexington, KY (US); Herman Anthony Smith, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/423,452

(22) Filed: Apr. 25, 2003

(65) Prior Publication Data

US 2003/0193132 A1 Oct. 16, 2003

Related U.S. Application Data

(63) Continuation of application No. 10/073,650, filed on Feb. 11, 2002, now Pat. No. 6,637,742.

(51) Int. Cl.[7] ..... B41J 2/01; B65H 29/46

(52) U.S. Cl. ..... 271/84; 347/16; 347/104; 400/625

(58) Field of Search ..... 271/84; 347/16, 347/104; 400/625

(56) References Cited

U.S. PATENT DOCUMENTS

| | | | | |
|---|---|---|---|---|
| 5,207,858 | A | 5/1993 | DeBarber et al. | 156/441.5 |
| 5,226,743 | A | 7/1993 | Jackson et al. | 400/625 |
| 5,244,294 | A | 9/1993 | Ewing | 400/625 |
| 5,299,875 | A | 4/1994 | Hock et al. | 400/625 |
| 5,326,090 | A | 7/1994 | Hock et al. | 271/162 |
| 5,427,462 | A | 6/1995 | Jackson et al. | 400/579 |
| 5,454,648 | A | 10/1995 | Lee | 400/48 |
| 5,603,493 | A | 2/1997 | Kelly | 271/188 |
| 5,624,196 | A | 4/1997 | Jackson et al. | 400/625 |
| 5,725,319 | A | 3/1998 | Saito et al. | 400/629 |
| 5,730,537 | A | 3/1998 | Kelly et al. | 400/625 |
| 5,745,141 | A | 4/1998 | Miyawaki | 347/104 |
| 5,758,981 | A | 6/1998 | Lesniak et al. | 400/625 |
| 5,767,884 | A | 6/1998 | Bortolotti et al. | 347/102 |
| 5,883,655 | A | 3/1999 | Szlucha | 347/104 |
| 5,890,821 | A | 4/1999 | Lesniak et al. | 400/625 |
| 5,927,705 | A | 7/1999 | Becker et al. | 271/114 |
| 5,993,094 | A | 11/1999 | Lee | 400/625 |
| 6,027,269 | A | 2/2000 | Yoshida | 400/625 |
| 6,074,055 | A | 6/2000 | Myung | 347/104 |
| 6,082,729 | A | 7/2000 | Padget | 271/121 |
| 6,135,444 | A | 10/2000 | Padget | 271/121 |
| 6,238,114 | B1 | 5/2001 | Bennett et al. | 400/625 |

*Primary Examiner*—Donald P. Walsh
*Assistant Examiner*—Kaitlin Joerger
(74) *Attorney, Agent, or Firm*—Taylor & Aust, P.C.

(57) ABSTRACT

A media eject system for a printer having an output tray includes an edge wing for supporting an edge of media exiting the printer, the edge wing movable between support and non-support positions. A kicker engages a trailing edge of media and moves the media into the tray. The kicker is movable between a retracted position and an extended position and operable to move the media into the tray by movement of the kicker from the retracted position to the extended position. A controller determines a print condition including at least one of a media type and a print format, and adjusts a position of the wing dependent upon the print condition.

20 Claims, 4 Drawing Sheets

MULTI-FUNCTION MEDIA EJECT SYSTEM IN AN INK JET PRINTER

This is a continuation of application Ser. No. 10/073,650 filed Feb. 11, 2002 now U.S. Pat. No. 6,637,742.

BACKGROUND OF THE INVENTION

1. Field of the Invention

The present invention relates to media ejection systems in printing devices, and, more particularly, to ejection systems for ink jet printers including support wings and media kickers, and methods for using such systems.

2. Description of the Related Art

Ink jet printers are used commonly for home and business printing applications. Ink jet printers are popular due to their low initial cost, low cost of operation, low energy use and quiet operating features. Ink jet printing involves ejection of tiny ink droplets through small holes, in a controlled manner, to create the desired image on the media. Ink is supplied from an ink reservoir to a printing head, which includes various passageways from the reservoir to one of a plurality of nozzle orifices. Energy is applied to the ink from an ink droplet generator near each orifice, which may include the application of electrostatic attraction, the application of oscillating forces from piezo elements, the application of heat from heating elements or the like. The printhead traverses back and forth in close proximity to the media being printed, and, as the various droplet generators are activated in the necessary pattern and sequence, the desired image is formed from the tiny ink droplets deposited on the surface of the media.

Laser printers are also used in both home and office applications. Although generally more costly than ink jet printers, laser printers are sometimes preferred for the perceived greater print quality and the faster printing speed available from laser printers.

For ink jet printers to compete more favorably with laser printers, it is necessary to increase the printing speed and the optical density of the printed image obtained from an ink jet printer. These performance increases in an ink jet printer must be achieved without increased occurrence of ink smear. Ink smear can occur when wet ink is contacted by the same piece of media, by another piece of media or by surfaces or devices in the printer.

It is known to support and delay printed media exiting the print area in an ink jet printer, to allow time for the ink to dry. Eject systems in ink jet printers are known to include movable wings along the edge of the media path to support the printed media from beneath, and kickers operated on the trailing edge of the media to assist in ejecting the media. Media supported by the edge wings may bow slightly, giving the media a degree of beam strength, while still remaining flat in the print zone. Supporting and handling media in this manner has been successful in reducing the incidence of smear for many common print job operations.

In some operating conditions, the devices intended to reduce the incidence of smear, namely the wings and kickers, can actually be responsible for increased incidence of smear, potential media jams, and/or slowed printer performance. For example, when printing in a draft mode, in which less ink is applied to the media, ejection systems using wings and kickers can slow overall printer performance, in that each cycle of the wings and kickers can require more time than necessary for the ink to dry. Printing banner paper of envelopes also can be slowed when wings and kickers are used.

Supporting banner paper or envelopes on edge wings can cause smear by urging the length of the media into direct physical contact with the printhead. When banner paper is supported on edge wings, after a considerable length thereof has passed through the exit system, the "beam" collapses. The result can be bunching of the banner paper in the print zone, resulting in physical interference between the banner paper and the printhead. With narrower, more rigid media such as envelopes, support from beneath by an edge wing along one side of the envelope can cause the entire length of the envelope to rise upward along the surface of the wing and rearward thereof into the printing area. Even relatively limited upward movement of the top surface of the media can cause physical interference between the media and the printhead, since the normal spacing therebetween is quite small. When any physical interference occurs between the media and the printhead, smear, lateral displacement of the media, or a media jam can be the result.

What is needed in the art is a multifunction media eject system that provides different edge support and kicker operations, depending on the type of print job performed and the type of media upon which printing is performed.

SUMMARY OF THE INVENTION

The present invention provides a multi-function media eject system particularly useful for ink jet printers, that positions edge support wings and sheet kickers differently for different printing formats and for different media types, thereby reducing potential smear and paper jams, and improving overall printer performance.

The invention provides, in one form thereof, a media eject system for a printer having an output tray. The system includes an edge wing for supporting an edge of media exiting the printer. The edge wing is movable between support and non-support positions. A kicker engages a trailing edge of media and moves the media into the tray. The kicker is movable between a retracted position and an extended position and operable to move the media into the tray by movement of the kicker from the retracted position to the extended position. A controller determines a print condition including at least one of a media type and a print format, and adjusts a position of the wing dependent upon the print condition.

In another from thereof, the invention provides a method for operating a media eject system of a printing device. The method includes the steps of providing edge wings having a wings up position for supporting media exiting the printer and a wings down position providing no support to media exiting the printer, and a kicker for moving media, the kicker having a retracted position and an extended position and adapted for moving the media as the kicker is moved from the retracted position to the extended position; determining a print condition for each print job, the print condition including at least one of a media type being printed and a printing format being used; and adjusting positions of the edge wings in response to the print condition, to selectively provide media support for specific print conditions, and to provide no media support for other specific print conditions.

In a further form thereof, the invention provides a method for operating a media ejection system during a print job in a printer, the media ejection system including edge support wings for supporting the media exiting the printer and a kicker for accelerating the media exiting the printer. The method includes steps of determining a print condition for the print job to be at least one of the conditions including the media being an envelope, the media being banner paper and the print format being a draft printing mode; and adjusting the wings to non-operating conditions in response to determining the print condition for the print job to be at least one of the conditions including the media being an envelope, the media being banner paper and the print format being a draft printing mode; and passing the media out of the printer without support by the wings.

In still another form thereof, the invention provides a method of operating a printer having an eject system including wings for supporting sheets of media exiting the printer. The method steps include determining the type of media being printed and the print format being used; and moving the wings to non-supporting positions if the media is banner paper or envelope, or if the if the print format is draft.

In a still further form thereof, the invention provides a method of operating a printer having an eject system including a kicker for accelerating the sheets of media exiting the printer. The method steps include determining the type of media being printed and the print format being used; and moving the kicker to a non-operative position if the media is banner paper or envelope, or if the if the print format is draft.

An advantage of the present invention is providing a multi-function eject system control with common eject system hardware, and reduced potential for media jams in the printer.

Another advantage is improving speed performance for draft mode printing while also reducing potential for smear when printing envelopes or banner paper.

Still another advantage is adjusting acceleration of the media without the use of kickers; and providing certainly that the exit area of the printer is cleared.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
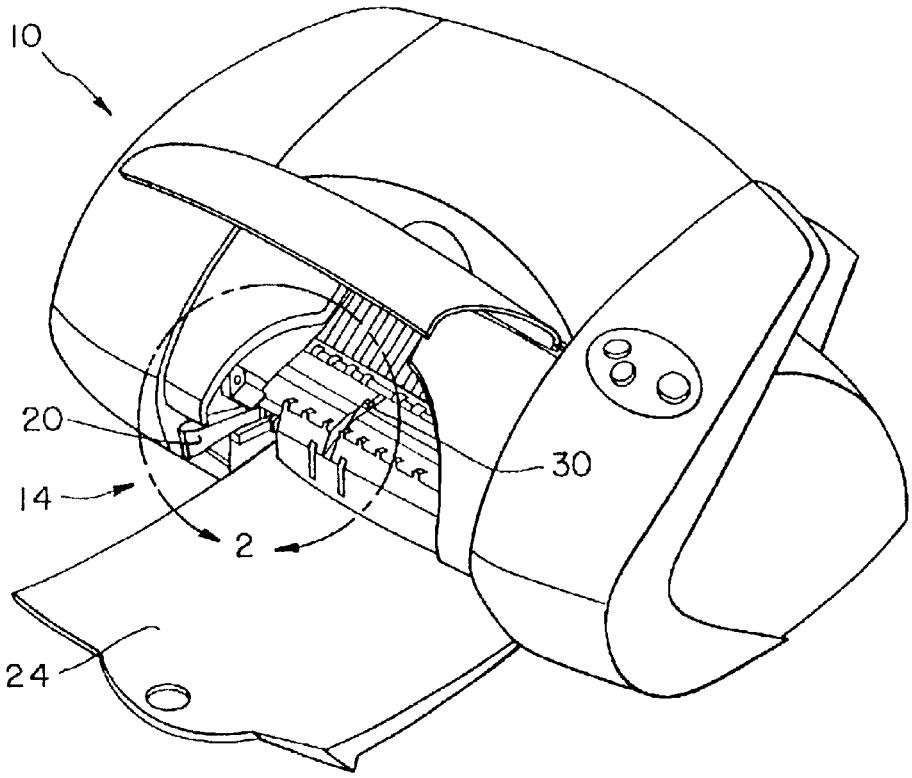
FIG. 1 is a perspective view of a printer in accordance with the present invention, illustrating the wings and kickers in a first position.
Figure 2:
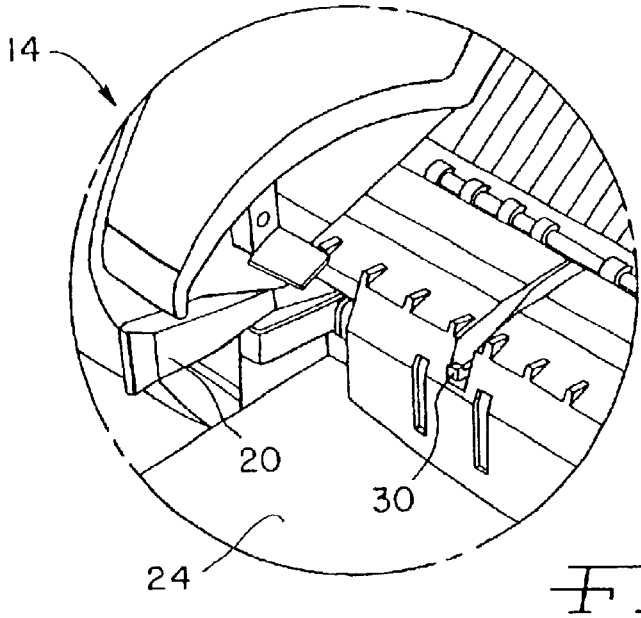
FIG. 2 is an enlarged perspective view of the circled portion of the printer shown in FIG. 1, but illustrating the wings and kickers in a second position.
Figure 3:
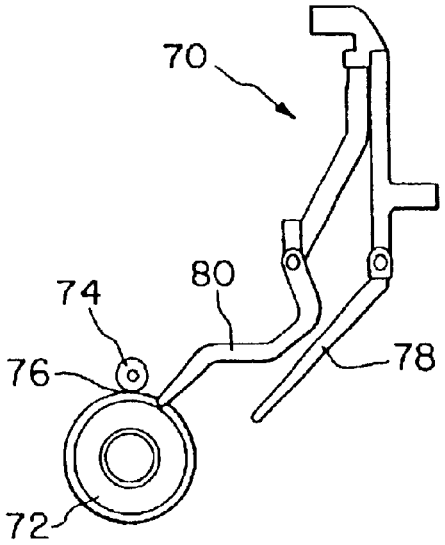
FIG. 3 is an elevational view of sheet end edge detection apparatus in accordance with the present invention.
Figure 4:
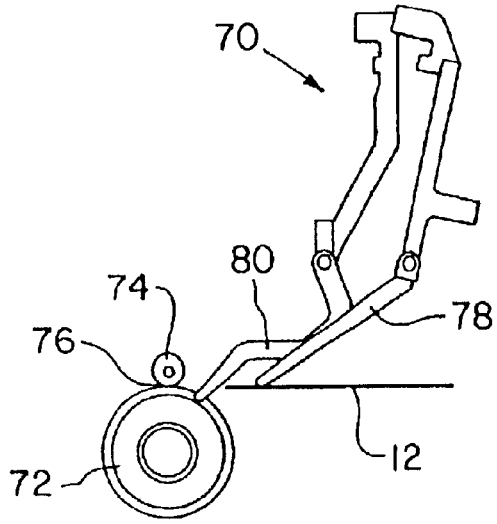
FIG. 4 is an elevational view similar to FIG. 3 but illustrating a front edge of the sheet having entered the end edge detection system.
Figure 5:
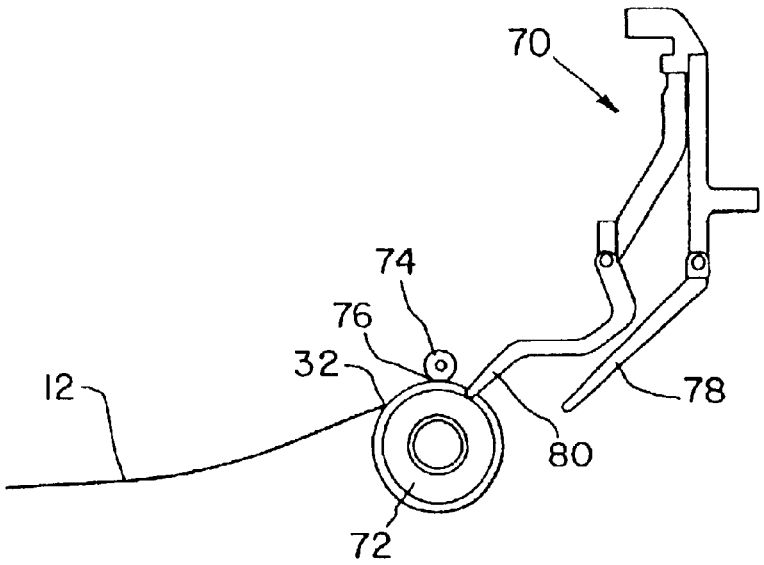
FIG. 5 is an elevational view similar to FIGS. 3 and 4, but illustrating the sheet having passed through the end edge detection system.
Figure 6:
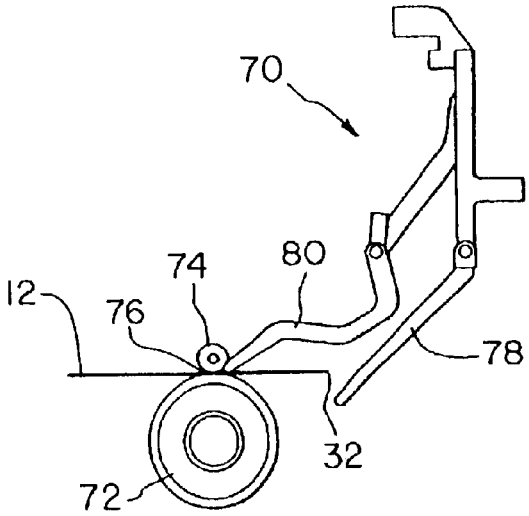
FIG. 6 is an elevational view similar to FIGS. 3–5, illustrating a reversal of the sheet in some operating conditions.

Referring now to the drawings and particularly to FIGS. 1 and 2, a printing device of the present invention, in the form of an ink jet printer 10 is illustrated. Ink jet printer 10 includes an ink jet cartridge, a frame, a carriage assembly for carrying the ink jet cartridge and other parts well-known to those skilled in the art, and not shown, illustrated or described herein for simplicity. In known manner, a plurality of rollers, guides and the like define a paper path through printer 10 along which media 12 passes from a supply tray or the like, through a printing zone and ultimately to an eject system 14 operated in accordance with the present invention. Media 12 can be conventional cut-sheet papers, envelopes, a continuous length of paper frequently referred to as banner paper, or the like. Printer 10 can be operated in a variety of printing modes, including higher quality, slower printing modes in which more ink is applied to the media, and a faster printing, lower quality mode referred to herein as a "draft" printing mode, in which less ink is applied. The present invention is useful for operating media ejection system 14 for all types of media printed in printer 10, and provides advantages particularly with respect to the ejection of heavier, stiff media such as envelopes or long or continuous media such as banner paper. Additionally, advantages are obtained for printing on conventional cut-sheet media when draft mode printing is selected.

Eject system 14 includes one or more edge wings 20, 22 disposed along the edge of the media path, generally at the outlet of printer 10, wherein the media is deposited into an output tray 24. Two such edge wings 20, 22 are illustrated in the drawings, in opposition to each other, to support media therebetween as the media leaves printer 10. In a first position of edge wings 20 and 22 support is provided to the side edges of media exiting printer 10, from the underside thereof, by wings 20 and 22. Media 12 rests on and slides along wings 20 and 22 as it progresses outwardly of the printer and into output try 24. In a second position of wings 20 and 22, each is positioned away from the media path, so as not to contact media 12 as it progresses outwardly from printer 10. Therefore, edge wings 20 and 22 are movable between a "wings up" position for supporting the media illustrated in FIG. 1, and a "wings down" position for non-support of the media, as illustrated in FIG. 2.

Eject system 14 of printer 10 further includes one or more kickers 30. Kickers 30 are arranged with respect to the media path, and are operated with respect to movement of media 12 passing along the media path to bump or otherwise urge a trailing end edge 32 of media 12, to more forcibly eject media 12 from printer 10.

The structure just described for eject system 14 is operated in known manner during printing such that, as printing on a sheet of media 12 is completed, and media 12 exits from printer 10, wings 20 and 22 are in the wings up position illustrated in FIG. 1. Kickers 30 are in the retracted position also illustrated in FIG. 1. Under normal operating conditions, wings 20 and 22 are in the wings up position and kickers 30 are retracted even before printing commences on media 12. As media 12 exits printer 10, edges of the media are supported from beneath by wings 20 and 22, and kickers 30 are poised for activation on trailing end edge 32. At an appropriate time, kickers 30 are activated to move from the retracted position illustrated in FIG. 1 to the extended position illustrated in FIG. 2. Kickers 30 thus engage end edge 32 of media 12, urging the media along the media path and into output tray 24. Substantially concurrently with the activation of kickers 30 from the retracted position to the extended position, wings 20 and 22 are moved from the wings up position illustrated in FIG. 1 to the wings down position illustrated in FIG. 2. Thus, side edge support of media 12 is removed, and media 12 drops into output tray 24. As printing begins on the next sheet of media 12, wings 20 and 22 are returned to the wings up position, and kickers 30 are retracted, in preparation for operation on the next sheet of media 12. Picking of a subsequent sheet of media 12 is often delayed until wings 20 and 22 and kickers 30 are reset into the wings up and retracted positions, respectively, to ensure proper timing of the wing and kicker operation as the subsequent sheet of media 12 emerges from printer 10.

Operating eject system 14 as just described works satisfactorily for most types of printing on conventional cut sheet papers. However, the delay resulting from actuation of edge wings 20 and 22 and kickers 30 can slow printing and output, particularly when printing in draft mode with a lower volume of ink applied to the surface of media 12. When printing envelopes, an envelope supported by a single edge wing 20 or 22 can ride upwardly and tilt, potentially interfering with the printhead cartridge (not shown).

Figure 7:
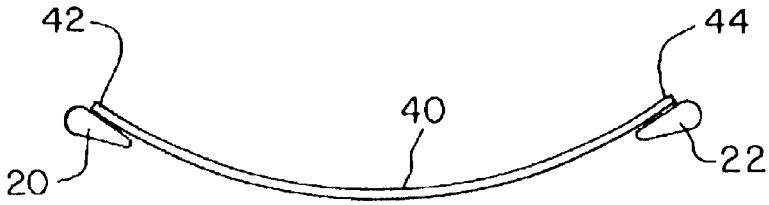
FIG. 7 is a cross-sectional view illustrating paper supported by edge wings of the present invention.
Figure 8:
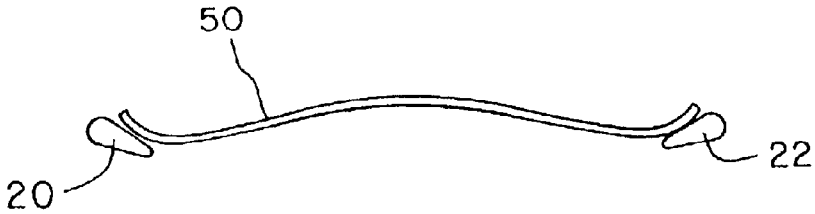
FIG. 8 is a cross-sectional view similar to FIG. 7, but illustrating a condition that can occur in prior art operations of ejection systems on some papers, such as banner paper.

When printing long or continuous sheets such as banner paper, a further problem can be encountered when operated in the manner described above. FIG. 7 illustrates a cut media sheet 40 supported by wings 20 and 22. The center of the sheet, between side edges 42 and 44 thereof, bows downwardly, substantially as illustrated. The curvature of cut sheet 40 provides a degree of "beam" strength to sheet 40, thus rendering the sheet more rigid, and reducing buckling occurring from the engagement of kickers 30. However, when a long sheet, or a continuous sheet such as banner paper 50 (FIG. 8) is processed in printer 10, as the extended length of banner paper 50 exits from printer 10 and falls into output tray 24, the curvature illustrated in FIG. 7 can collapse. As shown in FIG. 8, the center portion of banner paper 50 bulges upwardly, and the upward bulge thereof can extend back into the print zone of printer 10. Under these conditions, banner paper 50 can interfere with the print cartridge. If interference occurs between banner paper 50, an envelope, or any other media 12 and the print cartridge or other structures within printer 10, still wet ink on the surface of media 12 can be smeared or wet ink on the printhead can be rubbed onto media 12. Movement of the cartridge can cause media 12 to skew out of the proper orientation in the media path. Media jams can be caused when media 12 interferes with the print cartridge.

Figure 9:
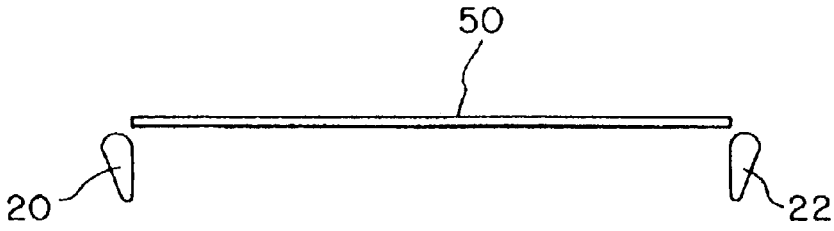
FIG. 9 is a cross-sectional view illustrating the present invention in use on banner paper.
Figure 10:
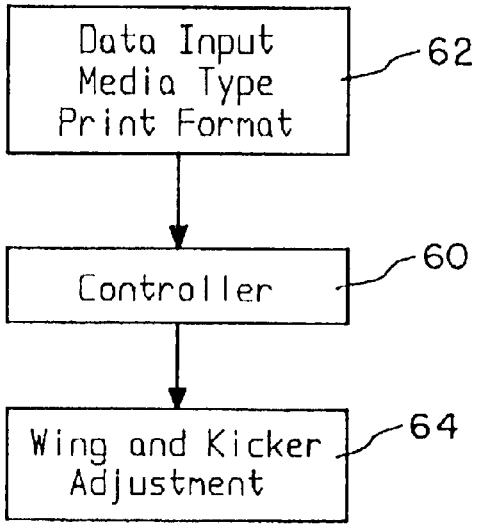
FIG. 10 is a flow diagram of the control of the eject system of the present invention.

In accordance with the present invention, the heretofore known operating sequences of edge wings 20 and 22 and kicker 30 are altered for various print conditions. Operation of printer 10 is controlled by a printer controller 60 (FIG. 10), which ascertains through appropriate sensors, and/or is provided with program data input 62 relative to the media being printed and the print format to be followed. If controller 60 determines that the print condition of printer 10 includes printing in draft mode, printing on media 12 comprising an envelope, and/or printing on media 12 comprising banner paper, controller 60 begins an alternative operating sequence for wings 20 and 22 and kickers 30. The alternative operating sequence includes adjustment 64 of the position for wings 20 and 22 and kicker 30 at the start of the print job. Wings 20 and 22 are moved to the wings down position, and kickers 30 are moved to the extended position illustrated in FIG. 2. In such positions, as media 12 exits from printer 10, edge wings 20 and 22 provide no support of media 12, and media 12 passes over kickers 30 without being influenced thereby. Media 12 in the form of envelopes will not ride up either of edge wings 20 or 22, and media 12 in the form of banner paper 50 will exit without curvature, as illustrated in FIG. 9. Thus, media 12 will not interfere with the print cartridge, or other surfaces in printer 10, and the potential for smear of printing on media 12 or media jamming is reduced. In draft printing mode of conventional cut sheets 40, throughput can be increased without the unnecessary operation of wings 20 and 22 and kickers 30 on cut sheet 40, and the cycling of wings 20 and 22 and kickers 30 between the positions shown in FIG. 1 and FIG. 2.

If controller 60 ascertains that media 12 is a conventional cut sheet 40, and that the print format is other than draft printing, wings 20 and 22 are adjusted to the wings up position, and kickers 30 are moved to the retracted position as illustrated in FIG. 1. Then, as cut sheet 40 exits from printer 10, kickers 30 are extended to provide impetus to the sheet, and wings 20 and 22 are simultaneously moved to the wings down position, removing bottom support of cut sheet 40 and allowing the sheet to drop into output tray 24.

Without the additional ejection force supplied by kickers 30, it is necessary that media 12 in the form of envelopes or banner paper 50, or cut sheets 40 printed in draft mode is transported along the media path with sufficient velocity to clear all structures and settle uniformly into output tray 24. In accordance with the present invention, an improved end edge sensor system 70 is provided (FIGS. 3–6). An exit roller 72 is operated with a backing roller 74 to form a nip 76 through which media 12 passes. A first upstream end edge sensor 78 and a second downstream end edge sensor 80 are provided near exit roller 72 and backing roller 74. Use of two end edge sensors 78 and 80 provides more accurate determination of end edge location. As media 12 passes through nip 76, trailing end edge 32 first passes and is sensed by first upstream end edge sensor 78 and secondly by second downstream end edge sensor 80. If printing is completed with a sufficient margin between the last print line and trailing end edge 32, exit roller 72 is accelerated to thereby accelerate media 12 and adequately expel media 12 into output tray 24.

However, if printing occurs sufficiently close to trailing end edge 32 that an insufficient length of media 12 remains for proper acceleration thereof, printer controller 60 actuates exit roller 72 to rotate in a reverse direction. Thus, media 12 is moved backward slightly, through nip 76, after printing has been completed. When a sufficient length of media 12 has been backed through exit nip 76, as illustrated in FIG. 6, exit roller 72 is again reversed in direction, moving media 12 forward, and accelerating media 12 sufficiently to expel media 12 adequately into output tray 24.

The eject function described immediately above is normally adequate for clearing the exit area of printer 10, particularly when used for printing conventional cut sheet media in a draft mode. However, to ensure that the exit area has been cleared when printing envelopes or banner paper, after the media has exited, eject system 14 can be run through a complete eject cycle to engage and move the media if a portion thereof remains in the exit area. In doing so, wings 20 and 22 are raised to the wings up position, and kickers 30 are retracted. A conventional eject function follows, with kickers 30 extended, and wings 20 and 22 lowered. Cycling eject system 14 in this way will clear away media that may not have completely exited printer 10. As stated previously, eject system 14 cycling in this manner is not normally required for printing in draft mode format on cut sheet media 12, so the advantages gained in speed are maintained by not cycling eject system 14. If system cycling is used for envelope or banner paper print jobs, speed is not normally as important a factor, and surety of media clearance while reducing potential for smear and jams is achieved.

After completion of a draft mode print job, or a print job using envelopes or banner paper, printer 10 remains in the wings down and kickers extended position of FIG. 2 until such time as a print job is started that requires support by wings 20 and 22 and operation of kickers 30. Upon the start of such a print job, eject system 14 will return to the wings up and kickers retracted position before a first piece of media 12 exits the printer, and will function as described above as each piece of media 12 in the print job exits the printer. Eject system 14 returns to the wings up kicker retracted position after each piece of media 12 is ejected by ejection system 14, and will remain so upon completion of the print job. Only upon printer controller 60 identifying that a print job is commencing in draft mode or using envelopes or banner paper as media 12 is eject system 14 again adjusted to the wings down and kicker extended configuration of FIG. 2 as the print job commences.

The present invention provides improved printer performance through the multi-function operation of a media eject system. In response to known print job print conditions, the eject system is either used to support and eject the media, or is in essence, deactivated, by moving edge wings and kickers into non-operational positions, thus allowing the media to exit the printer without influence by the edge wings and kickers. If necessary, exit speed of the media is adjusted, including the potential repositioning of the media such that adequate ejection speeds are achieved.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A media eject system for a printer having an output tray, said system comprising:

an edge wing for supporting an edge of media exiting the printer, said edge wing movable between support and non-support positions;

a kicker for engaging a trailing edge of media and moving the media into the tray, said kicker movable between a retracted position and an extended position and operable to move the media into the tray by movement of said kicker from said retracted position to said extended position; and a controller for determining a print condition including at least one of a media type and a print format, and for adjusting a position of said wing dependent upon said print condition.

2. The media eject system of claim 1, including a plurality of edge wings in spaced relation for supporting media therebetween when said wings are in said support position.

3. The media eject system of claim 1, including a plurality of kickers, said controller adjusting a position of said plurality of kickers dependent upon said print condition.

4. The media eject system of claim 1, said wing being in said non-support position for at least one sheet of the media when said print condition is at least one of the media type being an envelope and the print format being draft printing.

5. The media eject system of claim 4, said kicker being in a retracted position at a start of a print job.

6. The media eject system of claim 1, said kicker being in said extended position at the start of the print job in response to said print condition being at least one of the media type being an envelope, the media type being banner paper and the print format being draft printing.

7. A method for operating a media eject system of a printing device, said method comprising steps of:

providing edge wings having a wings up position for supporting media exiting the printer and a wings down position providing no support to media exiting the printer, and a kicker for moving media, the kicker having a retracted position and an extended position and adapted for moving the media as the kicker is moved from the retracted position to the extended position;

determining a print condition for each print job, the print condition including at least one of a media type being printed and a printing format being used; and adjusting positions of the edge wings in response to said print condition, to selectively provide media support for specific print conditions, and to provide no media support for other specific print conditions.

8. The method of claim 7, said adjusting step including lowering said wings to provide no media support in response to determining said print condition to be printing on media consisting of one of banner paper and an envelope.

9. The method of claim 7, including passing the media through the printer, and moving said wings through a cycle of raising the wings and lowering the wings after the media exits the printer.

10. The method of claim 7, said adjusting step including lowering said wings to provide no media support for at least one sheet of said media when said print condition is determined to be a draft printing format.

11. The method of claim 7, said adjusting step including lowering said wings to provide no media support for at least one sheet of said media when said print condition is determined to be an envelope printing condition.

12. The method of claim 7, said adjusting step including extending said kicker in response to said print condition being a banner paper exiting the printer.

13. The method of claim 7, including passing the media through the printer and moving the kicker through a cycle of retracting the kicker and extending the kicker after the media exits the printer.

14. The method of claim 7, including lowering said wings in response to determining said print condition to be printing on media consisting of one of banner paper and an envelope.

15. The method of claim 14, including passing the media through the printer, moving the wings through a cycle of raising the wings and lowering the wings, and moving the kicker through a cycle of retracting the kicker and extending the kicker, each said cycle performed after the media exits the printer.

16. The method of claim 7, said adjusting step including positioning said kicker in response to determining said print condition to be a draft printing format.

17. The method of claim 16, including lowering said wings in response to determining said print condition to be a draft printing format.

18. A method for operating a media ejection system during a print job in a printer, the media ejection system including edge support wings for supporting the media exiting the printer and a kicker for accelerating the media exiting the printer, said method comprising steps of:

determining a print condition for the print job to be at least one of the conditions including the media being an envelope, the media being banner paper and the print format being a draft printing mode; and adjusting the wings to non-operating conditions in response to determining the print condition for the print job to be at least one of the conditions including the media being an envelope, the media being banner paper and the print format being a draft printing mode; and passing the media out of the printer without support by the wings.

19. The method of claim 18, said step of adjusting the wings including lowering the wings to a nonsupport position at the start of the print job.

20. The method of claim 18, including raising then lowering the wings, and retracting then extending the kicker each time a piece of media in the print job passes out of the printer.

* * * * *